US007287605B2

(12) United States Patent
Van Steenwyk et al.

(10) Patent No.: US 7,287,605 B2
(45) Date of Patent: Oct. 30, 2007

(54) STEERABLE DRILLING APPARATUS HAVING A DIFFERENTIAL DISPLACEMENT SIDE-FORCE EXERTING MECHANISM

(75) Inventors: Donald H. Van Steenwyk, San Marino, CA (US); Raymond W. Teys, Pismo Beach, CA (US)

(73) Assignee: Scientific Drilling International, Houston, TX (US)

( * ) Notice: Subject to any disclaimer, the term of this patent is extended or adjusted under 35 U.S.C. 154(b) by 308 days.

(21) Appl. No.: 10/978,783

(22) Filed: Nov. 2, 2004

(65) Prior Publication Data

US 2006/0090935 A1 May 4, 2006

(51) Int. Cl.
*E21B 7/08* (2006.01)

(52) U.S. Cl. ..... 175/61; 175/26; 175/76; 175/99

(58) Field of Classification Search ..... 175/61, 175/26, 45, 74, 76, 99
See application file for complete search history.

(56) References Cited

U.S. PATENT DOCUMENTS

| | | | | | |
|---|---|---|---|---|---|
| 4,394,881 | A * | 7/1983 | Shirley | 175/76 |
| 4,471,843 | A | 9/1984 | Jones, Jr. et al. | |
| 4,635,736 | A | 1/1987 | Shirley | |
| 4,828,050 | A | 5/1989 | Hashimoto | |
| 5,038,872 | A | 8/1991 | Shirley | |
| 5,139,094 | A * | 8/1992 | Prevedel et al. | 175/61 |
| 5,265,682 | A | 11/1993 | Russell et al. | |
| 5,307,885 | A | 5/1994 | Kuwana et al. | |
| 5,353,884 | A | 10/1994 | Misawa et al. | |
| 5,520,255 | A * | 5/1996 | Barr et al. | 175/24 |
| 5,695,015 | A | 12/1997 | Barr et al. | |
| 5,803,185 | A * | 9/1998 | Barr et al. | 175/45 |
| 5,842,149 | A | 11/1998 | Harrell et al. | |
| 5,875,859 | A | 3/1999 | Ikeda et al. | |
| 5,941,323 | A | 8/1999 | Warren | |
| 5,979,570 | A | 11/1999 | McLoughlin et al. | |
| 6,116,355 | A | 9/2000 | Thorp et al. | |
| 6,158,529 | A * | 12/2000 | Dorel | 175/61 |
| 6,209,664 | B1 | 4/2001 | Chaffaut | |
| 6,244,361 | B1 | 6/2001 | Comeau et al. | |
| 6,257,356 | B1 * | 7/2001 | Wassell | 175/61 |
| 6,439,325 | B1 * | 8/2002 | Peters et al. | 175/325.5 |
| 2002/0011358 | A1 * | 1/2002 | Wassell | 175/73 |
| 2002/0088648 | A1 * | 7/2002 | Krueger et al. | 175/99 |
| 2003/0051919 | A1 * | 3/2003 | Moore et al. | 175/73 |
| 2004/0084219 | A1 | 5/2004 | Moore et al. | |

FOREIGN PATENT DOCUMENTS

| | | |
|---|---|---|
| EP | 0677640 | 10/1995 |
| GB | 2 257 182 A | 1/1993 |
| GB | 2 259 316 A | 3/1993 |
| WO | WO 01/04453 A1 | 1/2001 |

* cited by examiner

*Primary Examiner*—Jennifer H Gay
(74) *Attorney, Agent, or Firm*—William W. Haefliger

(57) ABSTRACT

An apparatus for steerable rotary drilling of a borehole having a wall in the earth comprising a mandrel having a central opening there through for the passage of drilling fluids. The mandrel having a lower connection for operatively connecting to a drill bit structure and an upper connection for operatively connecting to a drill string above said apparatus. The mandrel further having an intermediate portion, an outer housing surrounding longitudinal extent of the mandrel intermediate portion, a differential displacement drive within the outer housing, one or more pairs of radially-extensible, opposed side-force exerting elements controlled by the differential displacement drive to provide for side force exertion against the borehole wall.

18 Claims, 6 Drawing Sheets

STEERABLE DRILLING APPARATUS HAVING A DIFFERENTIAL DISPLACEMENT SIDE-FORCE EXERTING MECHANISM

BACKGROUND OF THE INVENTION

This invention relates generally to controlling of the direction of drilling a borehole in the earth, for causing that borehole to traverse a desired path within the earth.

Early apparatus and methods used for this purpose employed a device called a whipstock that was lowered into a borehole and oriented to the direction of desired borehole divergence from its initial path. This apparatus had a tapered portion that would force the drill bit to diverge in the oriented direction. Later apparatus and methods were developed that used a down-hole motor, driven by drilling-mud flow or other means. Such motors are typically mounted to the lower end of a bent subassembly such that the longitudinal axis of the motor, and the drilling bit at its lower end, are at a slight angle to the direction of the drill string above the bent subassembly. When it is desired to drill in a generally straight path, the motor may be not activated, if desired, and drill string is continuously rotated. When it is desired to cause the path of the borehole to diverge in a given direction, continuous rotation of the drill string is stopped. Then the drill string, bent subassembly, motor and bit are rotated to position the direction of bend in the bent subassembly in the desired direction of divergence, the upper part of the drill string is held in this position and the down-hole motor is started. This causes the borehole to diverge in the desired and selected direction. Down-hole motors are expensive and have a relatively short life while drilling.

As an alternative to the use of a bent subassembly and a down-hole motor, various other apparatus and methods have been developed for steerable rotary drilling. Most, if not all of these, provide some means of providing a sideways-direction force relative to the lower end of the drill string to cause the path of the drill string to diverge from a straight path.

Three early U.S. Pat. Nos. 4,394,881, 4,635,736 and 5,038,872, disclosed two spaced-apart centralizers that were mounted to a collar by a number of bladders or other flexible elements that were fluid-filled. Fluid passages connected upper bladders to lower bladders such that if an upper was compressed on the low side of the hole, a lower one would receive pressure on the high side of the hole to force the bit down. There were no sensor elements and no gain functions in the system.

Two other rotary steering developments are disclosed in prior patents, referred to as a modulated bias unit, GB 2,259,316 and U.S. Pat. No. 5,520,255, and a control unit, GB 2,257,182, U.S. Pat. Nos. 5,265,682 and 5,695,015. This apparatus is generally described in a Schlumberger brochure, "PowerDrive, The New Direction in Rotary Drilling".

The modulated bias unit as generally described in the brochure, is firmly attached to the drill string and bit and has piston-like members that can be pushed out to provide side force. The control unit provides control of valving for these pistons that results in cycling the actuators in the modulated bias unit to keep the force acting in a desired spacial direction, as the drill string and bit rotate. The valving for the bias units is controlled by a shaft at the output of the control unit. The shaft is stabilized in space about the rotation axis, but is not however stabilized with respect to level. The attitude of stabilization provides the direction in which the bias unit will push. The control unit basically provides a mechanical control of the bias unit. For example, the Summary in U.S. Pat. No. 5,265,682 states, "The invention also provides a steerable rotary drilling system comprising a roll stabilized instrument assembly having an output control shaft the rotational orientation of which represents a desired direction of steering . . . ". That patent does not disclose or include a "strapped-down" configuration of sensors. The Background of the Invention states, "With the drill collar rotating, the principle choice is between having the instrument package, including the sensors, fixed to the drill collar and rotating with it, or having the instrument package remain essentially stationary as the drill collar rotates around it (a so-called "roll-stabilized" system).

In U.S. Pat. No. 5,265,682, the use of roll sensors is discussed, as follows: "As previously mentioned, the roll sensors 27 carried by the carrier 12 may comprise a triad of mutually orthogonal linear accelerometers or magnetometers", and, "In order to stabilize the servo loop there may also be mounted on the carrier 12 an angular accelerometer. The signal from such an accelerometer already has inherent phase advance and can be integrated to give an angular velocity signal which can be mixed with the signals from the roll sensors to provide an output which accurately defines the orientation of the carrier."

U.S. Pat. No. 5,695,015 has a similar statement about "stabilized" vs. "strapped-down". In all of these control unit patents, the stabilization torque is obtained by vanes in the mud flow and brakes, either electrical or mechanical. Power generation is disclosed as being from the same vanes.

U.S. Pat. No. 5,803,185, entitled "Steerable Rotary Drilling Systems and Method of Operating Such Systems", appears to combine one of the earlier bias and control units with additional hardware such that the valving in the control unit can also be used to transmit data to the surface through pressure pulses.

U.S. Pat. No. 5,842,149, entitled "Closed Loop Drilling System", addresses steerable rotary drilling and other techniques. It shows and mentions "Directional Devices to Correct Drilling Direction". FIG. 3 shows apparatus adjacent to the bit that can push on the sides. Such apparatus does not appear to be described as stabilized in space. The shaft for the drill bit drive appears centralized, while control elements are described as being in a non-rotating part. For example, the patent states "An inclination device 266, such as one or more magnetometers and gyroscopes, are preferably disposed on the non-rotating sleeve 262 for determining the inclination of the sleeve 262".

U.S. Pat. No. 5,979,570 discloses an apparatus for selectively controlling, from the surface of the earth, a drilling direction of an inclined wellbore. The apparatus comprises a hollow rotatable mandrel having a concentric longitudinal bore, a single inner eccentric sleeve rotatably coupled about the mandrel and having an eccentric longitudinal bore, an outer housing rotatably coupled around the single inner eccentric sleeve and having an eccentric longitudinal bore with a weighted side adapted to seek the low side of the wellbore, a plurality of stabilizer shoes and a drive means to selectively drive the single inner eccentric sleeve with respect to the outer housing. Since the offset required to provide the desired divergence from the initial wellbore direction is created by the weighted off-center element, this apparatus is only of use in an inclined borehole and is not useful in a vertical, or near-vertical wellbore. Also, the drive means must be activated at the surface of the earth before entry of the drill string into the borehole.

U.S. Pat. Nos. 5,307,885, 5,353,884 and 5,875,859 disclose the use of one or more eccentric cylindrical members to provide for lateral displacement of a section of the drill pipe. Universal joints are used so that the direction of the bit with respect to the drill string axis of the bit can be changed by the eccentric members. The axial load on the drill bit is transferred around the segment having the universal joints through a fixed outer housing. International Application WO 01/04453 A1 discloses an approach very similar to those three patents, but the drill-pipe segment containing the universal joints is replaced by a flexible pipe section that can be directly bent by the eccentric cylindrical member. In these four patents, as well as with the previously-cited approaches using eccentric cylinders, the degree of lateral offset is controlled by differential rotation of the eccentric cylinders about the borehole axis.

All of the above prior disclosures lack the unusual advantages in construction, operation and results of the present invention.

SUMMARY OF THE INVENTION

An important object of the present invention is to provide a simpler and less-costly apparatus for steerable rotary drilling that overcomes shortcomings of prior art apparatus, and is useful in boreholes having any directional path, from vertical to horizontal and beyond, and enables its effective direction control force to be set while the drill string is within the borehole.

Another object of the invention is to provide a "side force" type of apparatus for rotary steerable drilling of a borehole in the earth, wherein a controlled differential displacement is provided between opposed pairs of side force elements that push against the borehole sides as drilling progresses.

Elements of apparatus for steerable rotary drilling of a borehole in the earth comprise:

a) a central portion or mandrel, having a central opening therethrough for the passage of drilling fluids, b) that central portion having a lower connection suitable for connecting to a drill bit, c) that central portion also having an upper connection suitable for connecting to a drill string, or other components, above the apparatus, d) an outer housing surrounding a longitudinal part of the central portion or mandrel, e) the outer housing having a rotary joint at its upper end for connection to the central portion and having a rotary joint for connection to the central portion so as to permit continuous rotation of the central portion about its longitudinal axis, f) one or more pairs of radially-extensible, opposed, side-force exerting elements controlled by a differential displacement drive mechanism within the outer housing to provide a side force exerted against the borehole wall, g) a pair of pistons associated with each pair of radially-extensible opposed side-force elements, h) one or more displacement transducers associated with each of said pair of pistons, i) control valves within the outer housing for control of the differential displacement drive mechanism and j) sensing, control and power supply elements to actuate the control valves so as to steer drilling in any desired direction.

Another object is to provide radially extensible elements configured to be automatically activated whenever there is pressure interior to said mandrel provided by said drilling fluid. Typically there are two pairs of such elements.

A further object is to provide sensing elements in the form of magnetometer, accelerometer, and/or gyroscopic elements.

An added object is to provide apparatus for directionally steering a rotary drilling bit in a borehole, comprising a) mandrel structure in a drill string above the bit, b) multiple side force exerting elements carried by the mandrel, c) and means for controllably and selectively exerting hydraulic pressure acting to control lateral displacement of said elements for engagement with the borehole wall, d) said means including directional control instrumentation sensitive to displacement or positioning of said elements relative to the borehole, including at least one of the following:

i) a gyroscope ii) an accelerometer iii) a magnetometer.

Such means may advantageous include position transducers carried by said side force exerting elements, and circuitry responsive to outputs of said transducers to control solenoid operated valves that in turn control application of borehole fluid pressure to actuators operatively connected to said side force exerting elements.

These and other objects and advantages of the invention, as well as the details of an illustrative embodiment, will be more fully understood from the following specification and drawings, in which:

DRAWING DESCRIPTION

Figures 2, 2A, 2B, 2C:
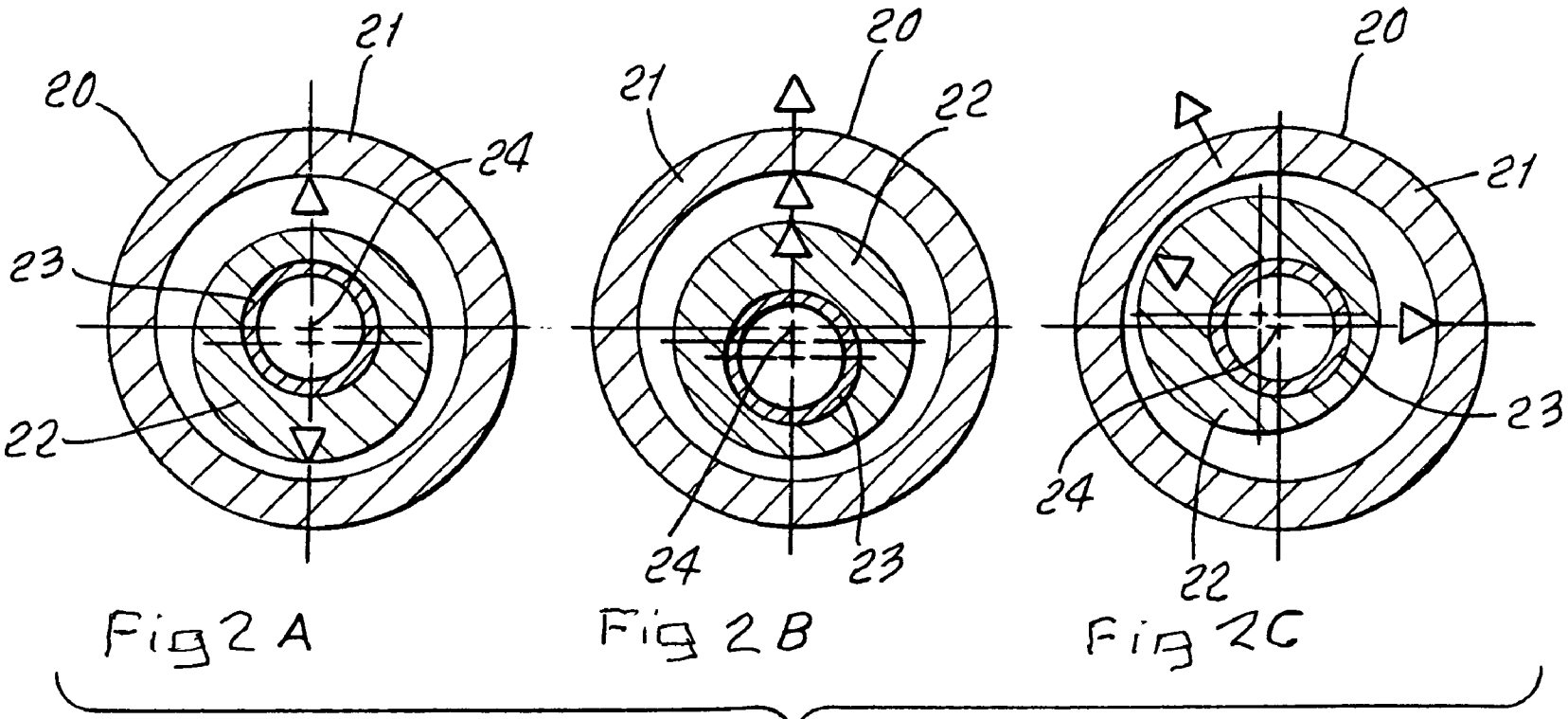
FIG. 2. PRIOR ART
FIG. 2 shows cross-sections A, B and C of a prior art device using eccentric cylinders for directional control.
Figure 2A:
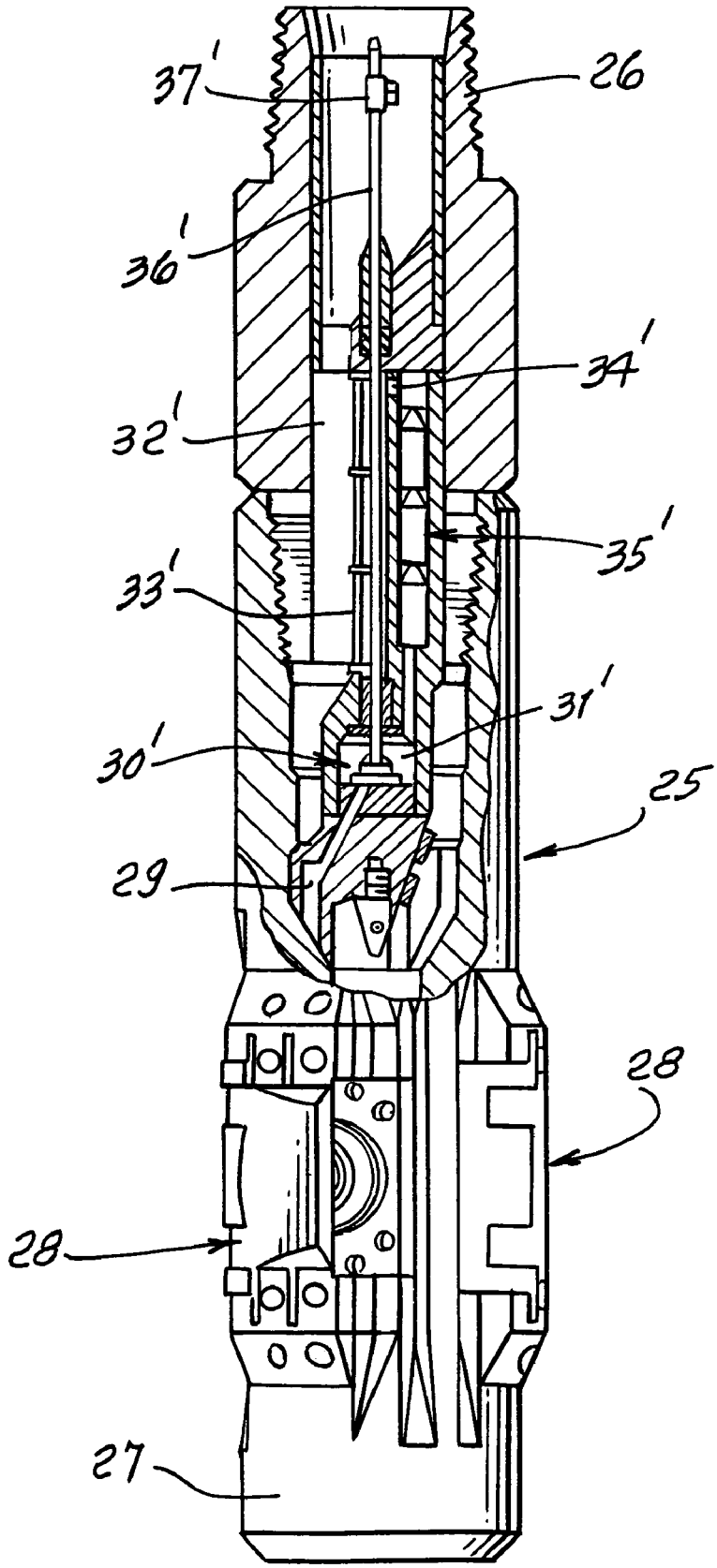
Figure 3:
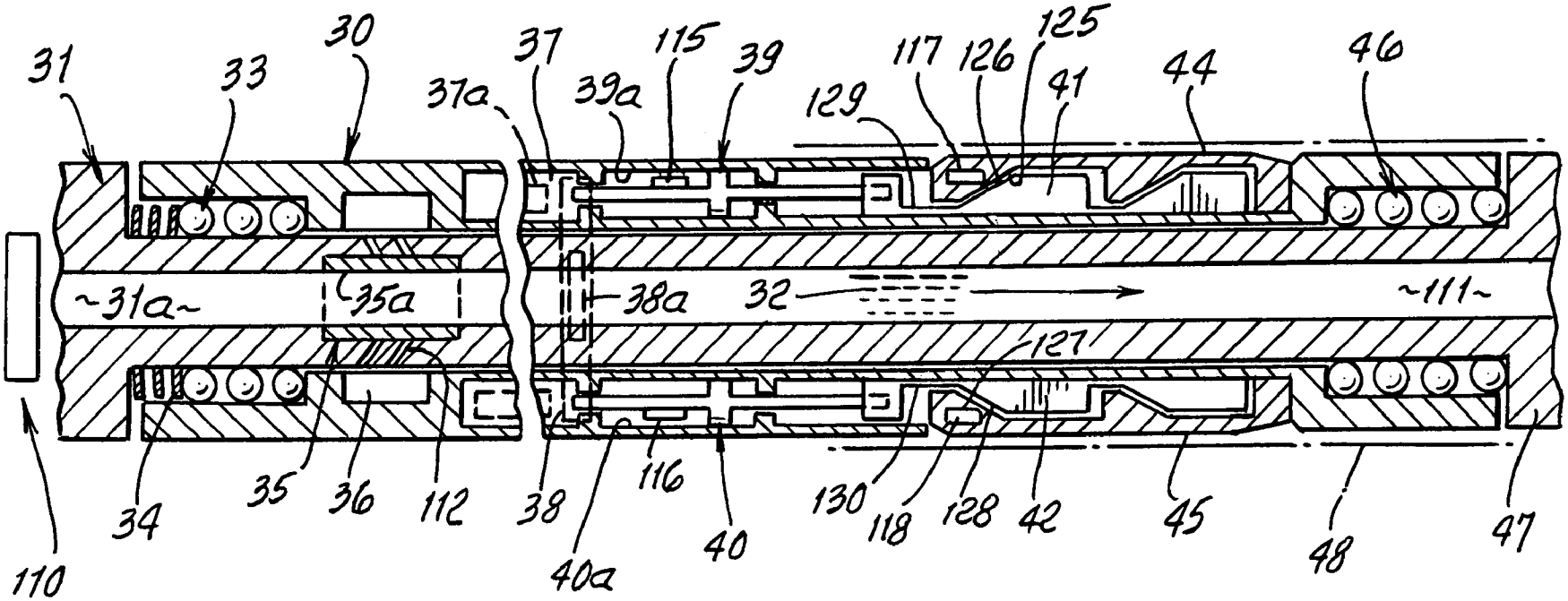
Figure 4:
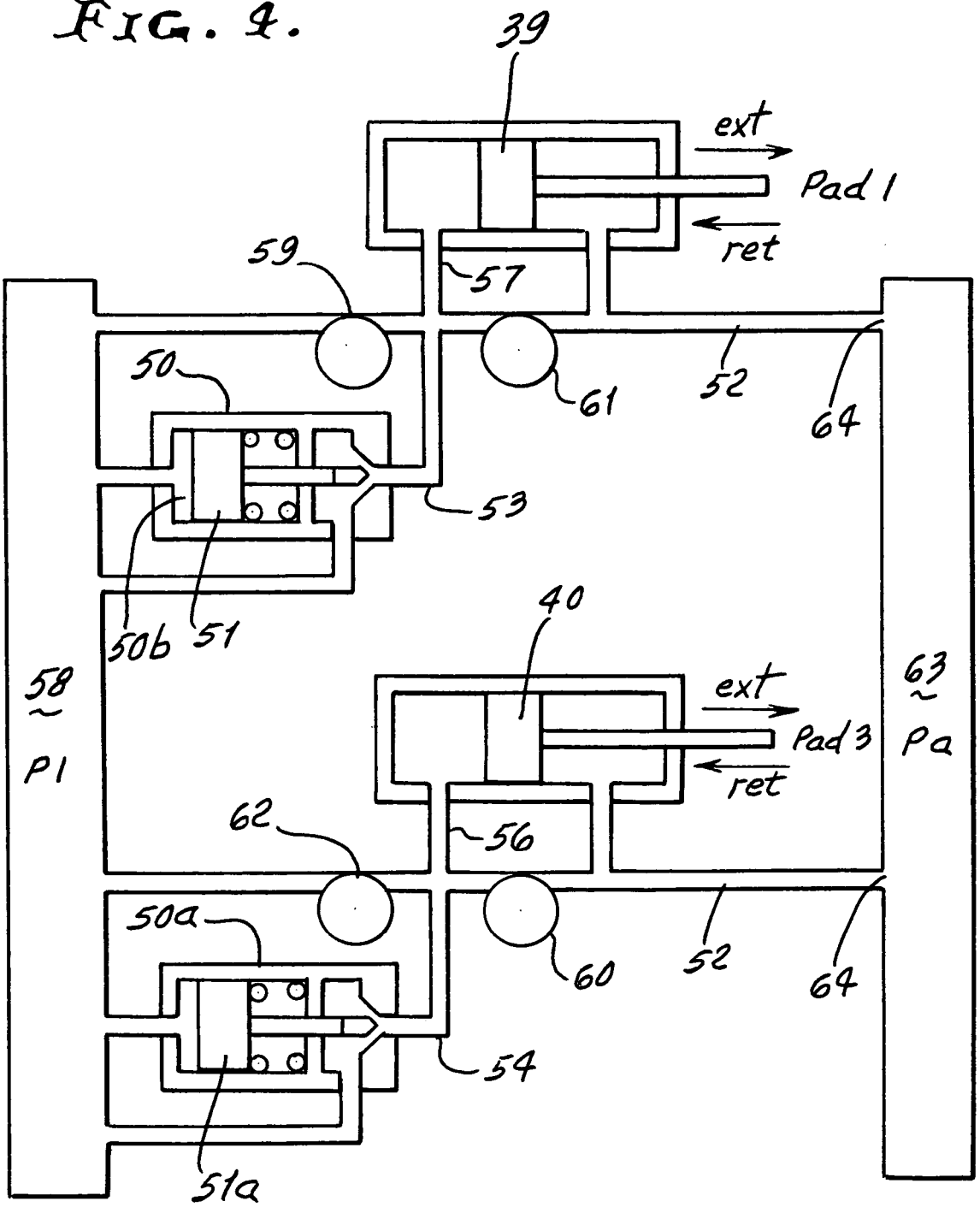
Figure 5:
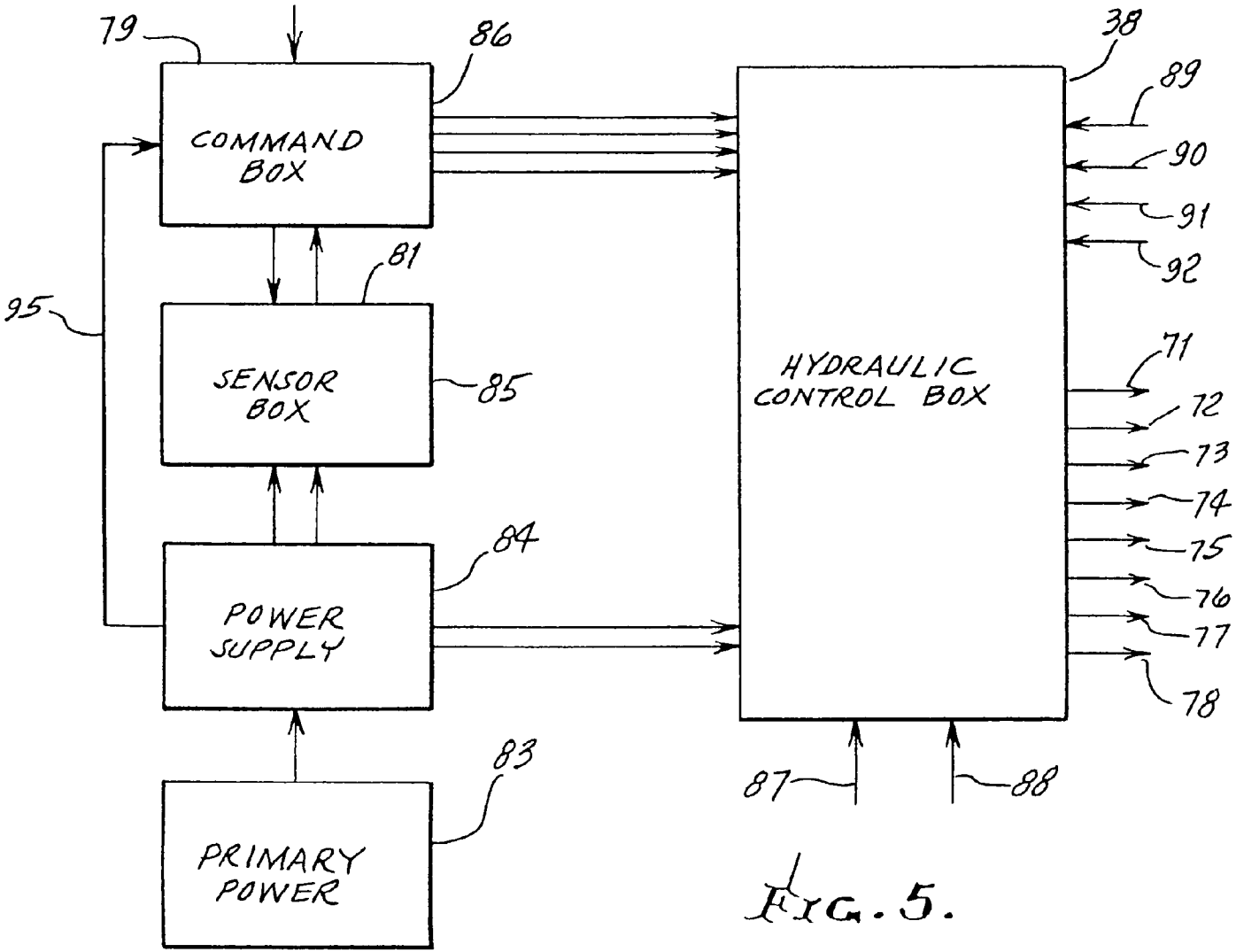

FIG. 2*a* shows a longitudinal cross-section of another prior art mechanism having a modulated bias unit;

FIG. 3 is a longitudinal cross-section of a steerable rotary drilling mechanism of the present invention;

FIG. 4 is a schematic diagram of hydraulic control circuits of the present invention;

FIG. 5 shows a block diagram of related measurement, control and power supply equipment used with the steerable rotary drilling mechanism of the present invention.

DETAILED DESCRIPTION

Figure 1:
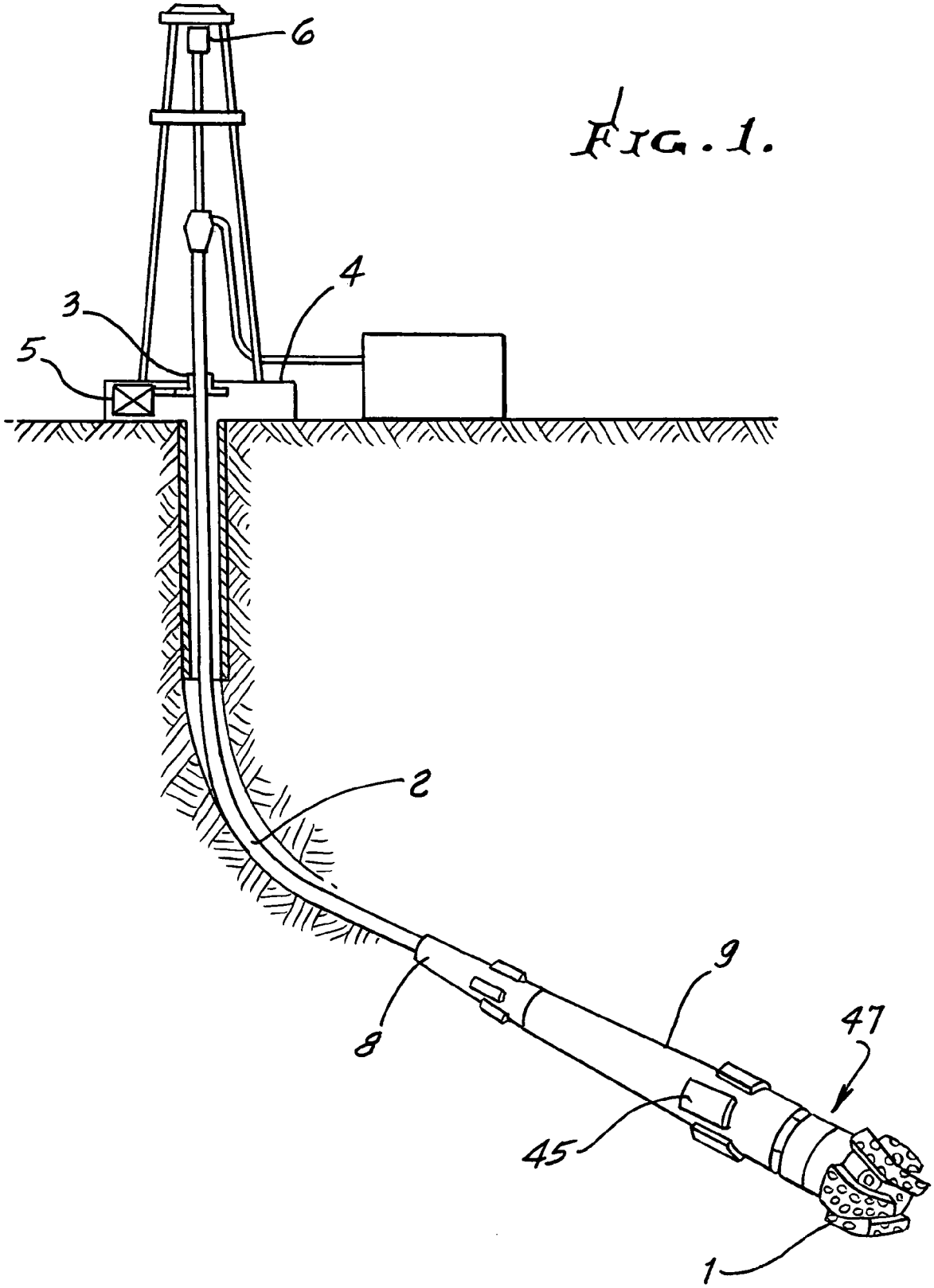
FIG. 1 shows a borehole in cross-section containing a steerable rotary drilling mechanism and also showing a typical desired path change for such a borehole.

FIG. 1 shows diagrammatically a typical rotary drilling installation of a kind in which the present invention may be used. The bottom hole assembly includes a drill bit 1 and is connected to the lower end of drill string 2 which is rotatably driven from the surface by a rotary table 3 on a drilling platform 4. The rotary table is driven by a drive motor 5. Raising and lowering of the drill string, and application of weight-on-bit, is under the control of draw works indicated diagrammatically at 6.

The bottom hole assembly includes a bearing section 8 for attachment to the drill string 2 that permits rotary motion between the drill string 2 and the steerable section 9. The outer surface of the steerable section 9 may be held in a fixed non-rotational direction or it may be allowed to rotate slowly as the drill string penetrates into the earth. Internal to the steerable section, a rotary element connects the drill string 2 to the drill bit 1. Radially-extensible side-force exertion elements 45 are provided at the lower end of the steerable section 9, that engage the bore wall and provide the side force acting on the bit enabling drilling to progress in any desired direction. The direction in space of the side force is typically controlled by elements within the steerable section 9.

PRIOR ART

FIG. 2 shows three cross-section views, normal to the borehole axis, of typical prior art deflection mechanisms that tend to bend the drill string to provide lateral deflection of the drill string with respect to an outer housing. Apparatus of this type is generally referred to as "point the bit" types since the axis of rotation of the bit is changed from the axis of rotation of the driving drill string. An outer cylindrical housing 20 contains two eccentric cylinders, the outer eccentric cylinder 21 and the inner eccentric cylinder 22. Interior to the inner eccentric cylinder 22 is the drill string pipe 23. The center of the outer cylindrical housing is at 24. In the left-hand cross-section A, the eccentric cylinders 21 and 22 are positioned with their eccentricities opposite each other so that the drill string pipe 23 is centered on the center of the outer cylindrical housing at 24. In the center cross-section B, the eccentricities of the eccentric cylinders are aligned and the drill string pipe 23 is displaced as shown below the center of the outer housing at 24. This orientation of the offset may be rotated around the borehole axis to cause deflection in any desired direction. Further, as shown in the right-hand cross-section C, the magnitude and direction of the offset may be set to any desired magnitude and direction by combination of the angular positions of the two eccentric cylinders.

FIG. 2*a*, adapted from U.S. Pat. No. 5,803,185, shows another type of apparatus that is generally referred to as a "side-force" type, since a side force is generated just above the bit to force the bit in the desired direction. The axis of rotation of the bit remains colinear with the axis of rotation of the driving drill string. The bottom hole assembly includes a modulated bias unit 25 to which the drill bit is connected and a roll stabilized control unit (not shown) which controls operation of the bias unit 25 in accordance with an on-board computer program, and/or in accordance with signals transmitted to the control unit from the surface. The bias unit 25 can be controlled to apply a lateral bias to the drill bit in a desired direction so as to control the direction of drilling.

Referring to FIG. 2*a*, the bias unit 25 comprises an elongate main body structure provided at its upper end with a threaded pin 26 for connecting the unit to a drill collar, incorporating the roll stabilized control unit, which is in turn connected to the lower end of the drill string. The lower end 27 of the body structure is formed with a socket to receive the threaded pin of the drill bit. Provided around the periphery of the bias unit, towards its lower end, are three equally spaced hydraulic actuators 28. Each hydraulic actuator 28 is supplied with drilling fluid under pressure through a respective passage 29 under the control of a rotatable disc control valve 30'-located in a cavity 31' in the body structure of the bias unit. Drilling fluid delivered under pressure downwardly through the interior of the drill string, in the normal manner, passes into a central passage 32' in the upper part of the bias unit, through a filter 33' consisting of closely spaced longitudinal wires, and through an inlet 34' into the upper end of a vertical multiple choke unit 35' through which the drilling fluid is delivered downwardly at an appropriate pressure to the cavity 31. The disc control valve 30 is controlled by an axial shaft 36' which is connected by a coupling 37' to the output shaft of the roll stabilized control unit.

PRESENT INVENTION

FIG. 3 shows a longitudinal cross-section of a steerable rotary drilling mechanism that provides lateral force applied at the bottom hole assembly to cause drilling to diverge or proceed in a desired direction. A housing 30 contains elements of the steerable assembly. Interior to the housing is a mandrel 31 with extends longitudinally through the assembly. At the upper end of the mandrel, means 110 are provided for operative connection to a rotary drill string. Interior to the mandrel, mud or other drilling fluids 32 may flow unrestricted toward a drill bit attached to the bit box 47, seen in FIG. 1. An upper thrust bearing 33 and associated thrust load spring 34 provide axial and radial support between the housing 30 and the mandrel. Another axial bearing 46 is provided at the lower end 111 of the mandrel just above the bit box. Interior to the mandrel, filter screens 35 provide filtered drilling fluid supplied from mandrel bore 31*a* to a rotary hydraulic fluid joint and clean fluid reservoir 36 for control of the apparatus. These items provide a path for clean drilling fluids from the bore of the mandrel 31 to the housing 30 Screens 35 are exposed at 35*a* to drilling fluid in the mandrel, and ducts 112 pass clean fluid to 36.

Space 37 for an electronics and power section is provided in the housing, and a hydraulic control system 38 is provided for the control of the apparatus. Numerals 37*a* and 38*a* designates these elements in 37 and 38. Two pistons or rams 39, 40 at opposite sides of the mandrel axis are controlled by the hydraulic control system 38. Two or more such pairs may be provided for complete 360° azimuth directional control of steering. Note that in FIG. 3 the elements are shown in a fully-retracted position, prior to the application of any pressure from the drilling fluid. A pair of radially-opposed side-force elements or pads 44, 45, later referred to as Pad 1 and Pad 3 respectively, are forced radially outwardly by inclined surfaces, on cam members 41, 42 as those members are controllably pushed axially by the pistons 39, 40 as commanded by the control system. These side-force exerting elements engage the nominal borehole wall indicated at 48. Pads 1, 2, 3 and 4 may be provided at 0°, 90°, 180° and 270 azimuth positions relative to the mandrel axis. When the same hydraulic pressure is applied to the two pistons 39 and 40, both side-force elements or pads 44 and 45 are radially extended symmetrically to engage the borehole wall. When the hydraulic control system provides different pressures in the two opposed pistons, the pads are differentially displaced, to effect drilling at a controlled angle or angles.

It is an important feature of the invention that this differential displacement is accurately controlled. One or more linear displacement transducers are typically provided to sense the linear position of each piston or pad. These transducers may be of suitable type and are shown schematically at 115 and 116, and at 117 and 118. They may sense either the axial displacement of the pistons or the radial displacement of the pads. From any of these measurements, the actual pad positions with respect to the housing may be obtained, as by instrumentation at 37*a*.

FIG. 3 also shows interengaged cam surfaces 125 and 126, and 127 and 128 on the piston driven actuators 129 and 130, and on the pads, to effect outward driving of the pads. Piston cylinders appear at 39*a* and at 40*a*.

FIG. 4 shows a schematic diagram of one version of the hydraulic control system. A source of filtered fluid at internal drill string pressure is shown at 58. This internal pressure is designated P1. A source of filtered fluid at the borehole annulus pressure outside of the housing 30 is shown at 63. This external annulus pressure is designate Pa. When the source of drilling fluid pressure, generally mud pumps is not operating, the internal Pressure P1 and the external annulus pressure Pa will be equal. When such pumps are operating, there will be a substantial pressure drop across the bit resulting from the mud flow through the bit. Thus the internal pressure P1 may typically be on the order of 300 to 600 p.s.i. higher than the external annulus pressure.

The charge/discharge valve 50 is spring loaded to expose channels 53, 54 (note high pressure from filtered source 58 is provided each channel and the upper piston 51) from internal pressure P1 to each of the pistons 51 and 51*a*. (Note channel 53 is connected to port 57 as is channel 54 to port 56). Other pairs of pistons not shown are similarly connected and nominally equally spaced to the pair shown. When the mud pumps are operated, the pressure P1 at 58 increases and is applied directly to the input channels to the valve controlled pistons. The pressure P1 is also applied to the upper surface of piston 51, forcing that piston downward and thus closing off the channel 53. The rate at which this happens is controlled by the bleed rate valve 51*a* which is connected from channel 52 to the port 64 on the external annulus pressure Pa source 63. This valve may be adjusted to the desired timing for each application circumstance. When the pumps are shut down and P1 is no longer greater than Pa, the spring-loaded chamber 50*b* in the charge/discharge valve 50 will slowly fill and once again open each piston to the Pa pressure. This relieves the charge of pressure P1 to the pistons allowing the pistons to relax to the retracted position.

A dual valve 59,60 is activated by a solenoid or other means for thrust control of piston #1 39 and relief of piston #3 40. Similarly, thrust control of piston #3 40 and relief of piston #1 39 is provided by dual valve 61,62. A similar arrangement is provided for each additional pair of pistons of radially opposed pistons in the apparatus. As shown in the figure, channels 54 and 56 would connect to a second pair of pistons.

When drilling is to begin, the pumps turn on to provide drilling fluid pressure, the pistons 51 and 51*a* are charged to pressure P1 and the charge/discharge valves 50 and 50*a* slowly compress shutting off the charge/discharge ports of each pad piston 39 and 40. As pressure builds up on the pistons, 51 and 51*a* connecting rods or actuators from the pistons activate the radially-extensible elements or pads outward to engage the borehole wall 48 of FIG. 3.

Assume for example that the apparatus is in a horizontal hole as seen in FIG. 3, and that pad #3 45 is on the low side of the hole and all of the cantilevered weight of the bottom hole assembly is resting on pad #3. Clearly, pads #1, #2 (not shown) and #4 (not shown) with no weight on them will expand to full gauge of the borehole. Assume that it is intended to drill straight ahead. This requires that the radial extension of all pads be the same and that the bit is centered in the borehole. Position transducers are typically provided on each of the pistons to provide signals as to the actual position of each piston and therefore equivalently for each pad. With respect to the opposing pistons shown, these signals are subtracted to provide an error signal that opens valves 61,62 so as to force pad #1 to retract and pad #3 to extend. When they reach equivalent positions, the error signal is reduced and the drill bit is centered in the borehole parallel to the axes of the pair of pistons. Similarly, but not shown, a second pair of pads #2 and #4 would equalize their extension. The transducers may comprise one of the following: gyroscope, magnetometer, and accelerometer.

If it is desired to build up the angle of the borehole, a command signal at 131 is sent to the control system, for example to solenoids, that will operate valves 61,62 so as to cause hydraulic piston activation to extend pad #3 to a greater amount and retract pad #1 by an equal amount. This places the drill bit above the centerline of the borehole and thus causes the direction of the hole to move upward. Similarly, if it is desired to drop the angle of the borehole, the opposite actions would be commanded. The same procedure can be used with a second pair of pads to cause the borehole direction to move left or right. In all of these actions, the opposed pads of each pair maintain their average radial position and individually have a differential displacement. This controlled action results in the pads continually engaging the borehole wall and stabilizing the orientation of the bit in the borehole for most efficient drilling.

FIG. 5 shows a block diagram of related measurement, control and power supply equipment typical of such elements used with the present invention. The main blocks are a hydraulic control box 38, a command box 86, a sensor box 85, a power supply 84 and a primary power source 83. Connections 71 to 78 represent hydraulic lines to each end of four piston cylinders. Connections 89 to 92 represent displacement signals from four pistons or pads. Inputs 87 and 88 represent inputs of the internal drilling fluid pressure P1 and the annulus drilling fluid pressure Pa. Sensors for these pressures may be of any suitable type. The command box 86 accepts inputs 79 from other equipment to provide either discrete directional commands or a general desired pathway for the borehole. Based on other inputs 81 from the sensor box and power 95 from the power supply, the command box sends by line 80 commands for the positioning of each of the pistons to the hydraulic control box which uses such commands to carry out the operations described above. The sensor box 85 contains all of the sensors that may be desired or needed to control the apparatus. Such sensors may include one or more accelerometers, one or more magnetometers, one or more gyroscopes, various logging sensors and/or various drilling-condition sensors. The power supply box provide any needed regulation, secondary power conversions and distribution of secondary of electrical power. The primary power supply may be batteries or a generator powered by the drilling fluid flow.

It will be clear to those skilled in the art, that pairs of radially-extensible side force elements or pads can be replaced by any suitable odd number of such elements. For example, three such elements may be used and equivalent commands for pairs of elements can then be resolved into the three directions of operations of such elements.

We claim:

1. An apparatus for steerable rotary drilling of a borehole having a wall in the earth comprising:

a) a longitudinally axially extending mandrel, having a central opening there through for the passage of drilling fluids, b) said mandrel having a lower connection for operatively connecting to a drill bit structure, c) said mandrel having an upper connection for operatively connecting to a drill string above said apparatus, and the mandrel having an intermediate portion, d) an outer generally cylindrical housing surrounding longitudinal extent of said mandrel intermediate portion, e) a differential displacement drive within the outer housing, f) one or more pairs of radially-extensible, opposed side-force exerting elements controlled by said differential displacement drive to provide for side force exertion against the said borehole wall, g) said drive including a pair of pistons for activating each pair of radially-extensible opposed side-force elements, said pistons movable longitudinally in parallel relation to the mandrel, there being actuators movable longitudinally by the pistons, between the mandrel and said outer housing, and there being camming surfaces interengageable between the actuators and said side-force exerting elements for displacing said elements generally radially away from the mandrel in response to said piston longitudinal movement, each piston being in longitudinal alignment with an actuator and a pair of camming surfaces, h) one or more displacement transducers for said pair of pistons, i) control valves within said outer housing for fluid pressure control of said differential displacement drive, and j) sensing, control and power supply elements to control operation of said control valves, to steer drilling in a desired direction by selective operation of said side force exerting elements.

2. The apparatus of claim 1 wherein said radially-extensible side-force exerting elements are configured to be automatically activated whenever there is pressure interior to said mandrel provided by said drilling fluid.

3. The apparatus of claim 1 wherein said differential displacement mechanism has positions controlled relative to the said outer housing to direct side-force in selected direction or directions.

4. The apparatus of claim 1 wherein the number of said pairs of radially-extensible opposed side-force elements is two.

5. The apparatus of claim 1 wherein said pistons have communication with pressure of said drilling fluid, whereby the side force exerting elements are powered by said pressure.

6. The apparatus of claim 1 wherein said sensing elements include at least one of the following:

i) a gyroscope ii) an accelerometer.

7. The apparatus of claim 1 wherein said sensing elements include at least one of the following:

i) a magnetometer ii) an accelerometer.

8. An apparatus for steerable rotary drilling of a borehole in the earth, the borehole having wall, comprising:

a) a mandrel, having a central opening therethrough for the passage of drilling fluids, b) said mandrel operatively connecting to a drill bit, c) said mandrel operatively connecting to a drill string above said apparatus, the mandrel also having an intermediate portion, d) an outer housing surrounding longitudinal extent of said mandrel, e) there being a rotary joint at or near the mandrel upper end for operative connection to said mandrel and there being a rotary joint at or near the mandrel lower end for operative connection to said mandrel so as to permit continuous rotation of said mandrel about a its longitudinal axis, f) one or more radially-extensible opposed side-force exerting elements controlled by a differential displacement drive mechanism within said outer housing to provide for exertion of side-force against the said borehole wall, g) said drive mechanism including pistons supported for longitudinal movement for activating each of said radially-extensible opposed side-force elements, there being piston driven actuators movable longitudinally to exert camming force for driving said elements, h) control valves within said outer housing for fluid pressure control of said differential displacement drive mechanism, and i) sensing, control and power supply elements to control operation of said control valves to steer drilling in a desired direction, by selective operation of said side force exerting elements, said sensing elements including one or more displacement transducers for each of said pistons.

9. The apparatus of claim 8 wherein said radially-extensible side-force exerting elements are configured to be automatically activated whenever there is pressure interior to said mandrel provided by said drilling fluid.

10. The apparatus of claim 8 wherein said differential displacement mechanism has positions controlled relative to the said outer housing to direct side-force in a selected direction or directions.

11. The apparatus of claim 8 wherein there are two pairs of radially-extensible opposed side-force elements.

12. The apparatus of claim 8 wherein said pistons have controlled communication with pressure of said drilling fluid, whereby the side force exerting elements are controllably powered by said pressure.

13. The apparatus of claim 8 wherein said sensing elements include at least one of the following:

i) a gyroscope ii) an accelerometer.

14. The apparatus of claim 8 wherein said sensing elements include at least one of the following:

i) a magnetometer ii) an accelerometer.

15. Apparatus for directionally steering a rotary drilling bit in a borehole, comprising a) mandrel structure in a drill string above the bit, b) multiple side force exerting elements carried by the mandrel, c) and means for controllably and selectively exerting hydraulic pressure acting longitudinally to control lateral displacement of said elements for engagement with the borehole wall, d) said means including directional control instrumentation sensitive to displacement or positioning of the mandrel relative to the borehole including at least one of the following:

i) a gyroscope ii) an accelerometer iii) a magnetometer, e) said means including longitudinally spaced first and second sets of interengaged cams operatively connected to each of said side force exerting elements.

16. The apparatus of claim 15 wherein said means includes actuators responsive to application of drilling fluid pressure.

17. The apparatus of claim 15 including a chamber or chambers within the mandrel containing said at least one of the following:

i) a gyroscope ii) an accelerometer iii) a magnetometer.

18. The apparatus of claim 15 wherein said means includes position transducers carried by said side force exerting elements, and circuitry responsive to outputs of said transducers to control solenoid operated valves that in turn control application of borehole fluid pressure to actuators operatively connected to said side force exerting elements.

* * * * *